US011572887B2

(12) United States Patent
Nagao

(10) Patent No.: US 11,572,887 B2
(45) Date of Patent: Feb. 7, 2023

(54) COMPRESSOR

(71) Applicant: MITSUBISHI HEAVY INDUSTRIES COMPRESSOR CORPORATION, Tokyo (JP)

(72) Inventor: Hideki Nagao, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 0 days.

(21) Appl. No.: 17/648,015

(22) Filed: Jan. 14, 2022

(65) Prior Publication Data

US 2022/0268292 A1 Aug. 25, 2022

(30) Foreign Application Priority Data

Feb. 25, 2021 (JP) ..... JP2021-028529

(51) Int. Cl.
*F04D 29/22* (2006.01)
*F04D 17/12* (2006.01)
*F04D 29/42* (2006.01)

(52) U.S. Cl.
CPC ..... *F04D 29/22* (2013.01); *F04D 17/12* (2013.01); *F04D 29/42* (2013.01)

(58) Field of Classification Search
None
See application file for complete search history.

(56) References Cited

U.S. PATENT DOCUMENTS

| | | | | |
|---|---|---|---|---|
| 2,650,753 | A | 9/1953 | Howard et al. | |
| 4,770,605 | A * | 9/1988 | Nakatomi | F04D 29/462 415/164 |
| 8,967,960 | B2 | 3/2015 | Guenard | |
| 9,903,374 | B2 | 2/2018 | Kosamana et al. | |
| 2021/0095691 | A1* | 4/2021 | Yanagisawa | F04D 29/624 |

FOREIGN PATENT DOCUMENTS

| | | | | |
|---|---|---|---|---|
| CN | 105308265 | B * | 4/2018 | F01D 5/066 |
| EP | 3339655 | A1 * | 6/2018 | F04D 17/122 |
| EP | 3450765 | A1 * | 3/2019 | F04D 17/12 |
| EP | 3690255 | A1 * | 8/2020 | F01D 25/243 |
| GB | 2033541 | A * | 5/1980 | B63H 1/20 |
| JP | S58-048797 | A | 3/1983 | |
| WO | WO-2013021515 | A1 * | 2/2013 | F04D 17/12 |
| WO | 2014/013020 | A1 | 1/2014 | |
| WO | WO-2019038921 | A1 * | 2/2019 | B21D 43/003 |
| WO | WO-2022070654 | A1 * | 4/2022 | |

* cited by examiner

*Primary Examiner* — Michael Lebentritt
(74) *Attorney, Agent, or Firm* — Osha Bergman Watanabe & Burton LLP

(57) ABSTRACT

A compressor has a rotor. The rotor includes a plurality of impellers that include a disk having a solid structure having a buried center, and are adjacent to each other in an axial direction, and a plurality of bolts for fixing the plurality of impellers together. The disk has a disk surface facing the axial direction and a bolt hole penetrating the disk at a position deviated outward from an axis in a radial direction. The disk surface includes a contact surface of which at least a part is located outside the bolt hole in the radial direction, and a non-contact surface which is a region inside the contact surface in the radial direction.

6 Claims, 5 Drawing Sheets

COMPRESSOR

BACKGROUND OF THE INVENTION

Field of the Invention

The present disclosure relates to a compressor.

Priority is claimed on Japanese Patent Application No. 2021-028529, filed on Feb. 25, 2021, the content of which is incorporated herein by reference.

Description of Related Art

Generally, a centrifugal compressor includes a rotor having a plurality of impellers and a casing that forms a flow path between the impellers and the casing by covering the impellers from the outside. In a centrifugal compressor, a fluid supplied from the outside through a flow path formed in the casing is compressed by rotations of the impellers.

For example, as described in U.S. Pat. No. 8,967,960, in such a centrifugal compressor, a rotor is formed by stacking a plurality of impellers in an axial direction. In this centrifugal compressor, the plurality of stacked impellers are fixed by a large bolt, which is a shaft disposed so as to insert a large hole formed in centers of the impellers.

SUMMARY OF THE INVENTION

By the way, when the large hole into which the shaft is inserted is opened in the centers of the impeller as described above, a thin portion is formed around the hole. Then, a load due to a centrifugal force when the rotor is rotated acts mainly on the thin portion around the hole. Further, this load increases in proportion to the centrifugal force that increases as a rotation speed of the rotor increases. Therefore, when an attempt is made to rotate the rotor having the impellers fixed by a shaft at a high speed, the impellers cannot withstand a large load due to the centrifugal force and may be damaged.

The present disclosure provides a compressor capable of improving strength of the impeller against a load due to centrifugal force while rotating a rotor stably at high speed.

According to an aspect of the present disclosure, there is provided a compressor including: a rotor that is rotatable about an axis; and a casing that covers the rotor from an outside in a radial direction around the axis, in which the rotor includes a plurality of impellers that are adjacent to each other in an axial direction in which the axis extends, wherein each of the a plurality of impellers includes a disk having a solid structure having a buried center and formed in a disk shape centered on the axis, and a bolt fixing portion having a plurality of bolts that is configured to fix the plurality of impellers arranged in the axial direction together, the disk includes a disk surface that is centered on the axis when viewed from the axial direction and faces the axial direction, and a plurality of bolt holes which are formed on the disk surface in a circumferential direction centered on the axis so as to penetrate the disk in the axial direction at a position deviated outward from the axis in the radial direction and through which the bolts are inserted, and the disk surface includes a contact surface which is at least partly located outside the bolt hole in the radial direction and is in contact with the disk surface of another adjacent impeller, and a non-contact surface that is a region of the disk surface inside the contact surface in the radial direction and is separated from the disk surface of another adjacent impeller in the axial direction.

According to a compressor of the present disclosure, it is possible to improve strength of an impeller against a load due to a centrifugal force while rotating the rotor stably at high speed.

DETAILED DESCRIPTION OF THE INVENTION

Hereinafter, a mode for implementing a compressor 1 according to the present disclosure will be described with reference to the accompanying drawings. However, the present disclosure is not limited to embodiments.

(Configuration of Compressor)

Figure 1:
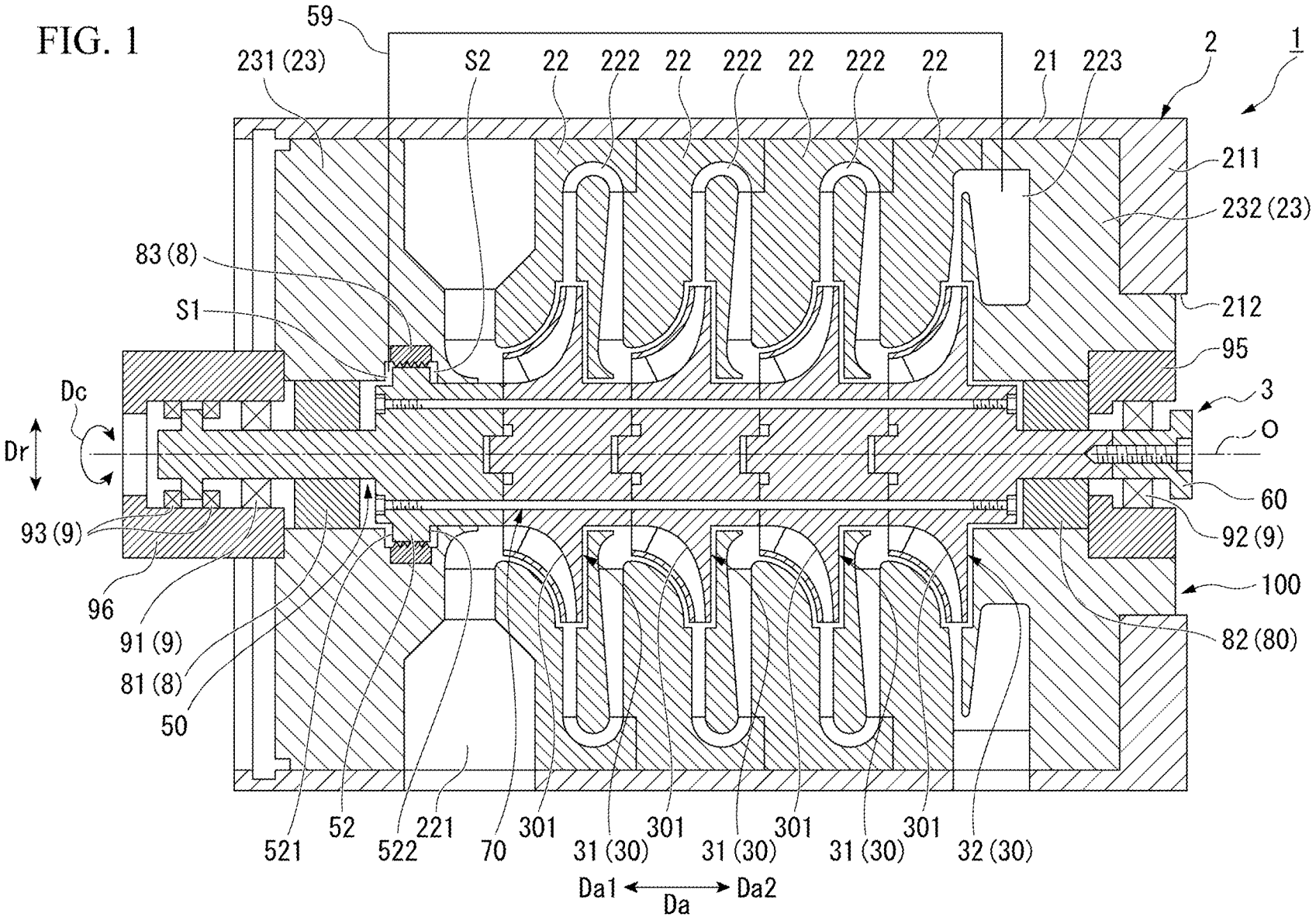
FIG. 1 is a cross-sectional view showing a schematic configuration of a compressor according to an embodiment of the present disclosure.

The compressor 1 compresses a gas as a working fluid. The compressor 1 of the present embodiment is a uniaxial multi-stage centrifugal compressor (multi-stage centrifugal compressor) that compresses hydrogen gas. As shown in FIG. 1, the compressor 1 includes a casing 2, a rotor 3, a seal portion 8, and a bearing portion 9.

In the following, a direction in which an axis O of the rotor 3 described below extends is referred to as an axial direction Da. A radial direction of the rotor 3 around the axis O is simply referred to as a radial direction Dr. Further, a direction around the rotor 3 centered on the axis O is defined as a circumferential direction Dc.

(Configuration of Casing)

The casing 2 covers the rotor 3 from the outside in the radial direction Dr. The casing 2 of the present embodiment has an outer casing 21, a plurality of diaphragms 22, and a plurality of heads 23.

The outer casing 21 has a cylindrical shape centered on a central axis disposed in the same manner as the axis O of the rotor 3. A first side Da1 (one side) of the outer casing 21 in the axial direction Da is opened with a size that allows a bundle 100, which will be described below, to be inserted. An end plate 211 is formed on a second side Da2 (the other side) of the outer casing 21 in the axial direction Da. The end plate 211 has a plate shape extending so as to be orthogonal to the axial direction Da. An insertion hole 212 having a size in which the rotor 3 can be inserted and the bundle 100 cannot be inserted is formed in a central portion of the end plate 211. As a result, the bundle 100 can be inserted into and removed from the casing 2 by being moved in the axial direction Da with respect to the outer casing 21.

The plurality of diaphragms 22 are disposed so as to cover the rotor 3 from the outside in the radial direction Dr. The plurality of diaphragms 22 are disposed inside the outer casing 21. The diaphragm 22 has an annular shape centered on the axis O. The plurality of diaphragms 22 are stacked so as to form a cylindrical shape extending in the axial direction Da. Outer peripheral surfaces of the adjacent diaphragms 22 are fixed to each other by welding or bolts. By fixing the plurality of diaphragms 22 to each other, a flow path to be introduced into the impeller 30 is formed inside. Further, the plurality of diaphragms 22 form the bundle 100 together with the head 23, the rotor 3, the seal portion 8, and the bearing portion 9. The bundle 100 is accommodated in the outer casing 21. In the bundle 100, the rotor 3, the plurality of diaphragms 22, the plurality of heads 23, the seal portion 8, and the bearing portion 9 are made movable together so as to be integrated with each other.

(Configuration of Flow Path)

Here, specifically, the flow path formed in the casing 2 by the diaphragms 22 will be described in order from an upstream side, which is the first side Da1 in the axial direction Da, to a downstream side, which is the second side Da2 in the axial direction Da. In the present embodiment, the diaphragms 22 form a suction port 221, a plurality of casing flow paths 222, and a discharge port 223 together with the outer casing 21 and the head 23 in this order from the upstream side through which the gas flows.

The suction port 221 allows an uncompressed gas that has flowed in from the outside of the casing 2 to flow into the inside of the diaphragm 22. The gas before flowing into the most upstream impeller 30 flows through the suction port 221. An inlet guide vane is disposed at the suction port 221.

The casing flow path 222 is formed in the diaphragm 22. The gas is supplied from the suction port 221 to the most upstream impeller 30, the gas discharged from the upstream impeller 30 is supplied to the impeller 30 disposed on the downstream side, and the gas discharged from the most downstream impeller 30 is fed to the discharge port 223, through the casing flow path 222.

The discharge port 223 discharges the compressed gas flowing inside the diaphragm 22 to the outside of the casing 2. The discharge port 223 discharges the gas discharged from the most downstream impeller 30 to the outside.

Each of the pair of heads 23 is a member having an annular shape and is disposed inside the outer casing 21. The head 23 is formed in a size capable of closing the openings at both ends of the outer casing 21. The head 23 of the present embodiment includes a suction-side head 231 disposed on the first side Da1 of the plurality of diaphragms 22 in the axial direction Da and a discharge-side head 232 disposed on the second side Da2 of the plurality of diaphragms 22 in the axial direction Da.

The suction-side head 231 is disposed at a position closer to the suction port 221 than the discharge-side head 232. The suction-side head 231 forms the suction port 221 together with a diaphragm 22 disposed to be closest to the first side Da1 in the axial direction Da. The suction-side head 231 is fixed to the plurality of integrated diaphragms 22 by bolts or the like. As a result, the suction-side head 231 is integrated with the diaphragms 22.

The discharge-side head 232 is disposed at a position closer to the discharge port 223 than the suction-side head 231. The discharge-side head 232 forms the discharge port 223 together with a diaphragm 22 disposed to be closest to the second side Da2 in the axial direction Da. The discharge-side head 232 is fixed to the plurality of integrated diaphragms 22 by bolts or the like. As a result, the discharge-side head 232 is integrated with the diaphragms 22.

(Configuration of Rotor)

Figure 2:
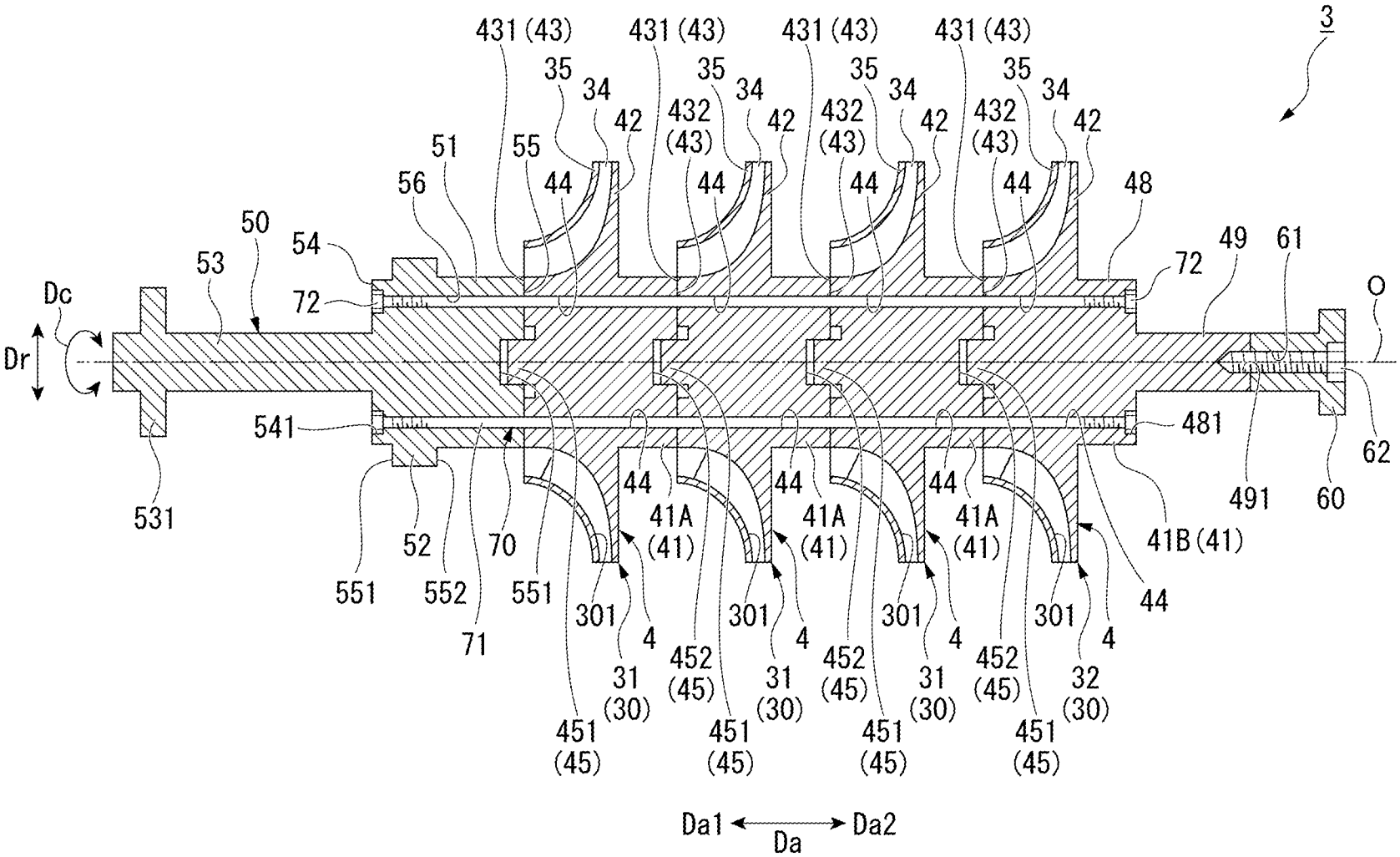
FIG. 2 is a cross-sectional view showing a rotor of the present embodiment.

The rotor 3 is accommodated inside the casing 2. The rotor 3 is rotatable about the axis O. As shown in FIG. 2, the rotor 3 of the present embodiment includes the plurality of impellers 30, a balance piston 50, a coupling hub 60, and a bolt fixing portion 70.

Figure 3:
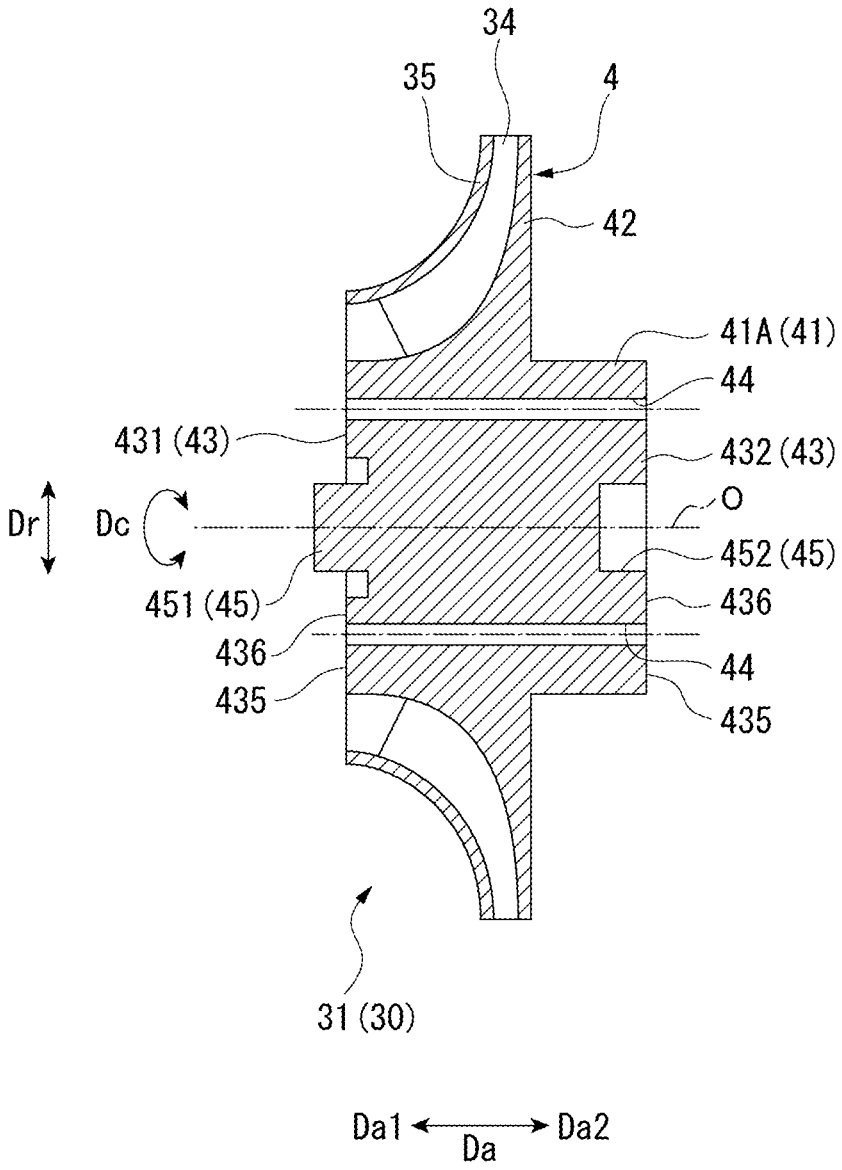
FIG. 3 is a cross-sectional view showing a first impeller of the present embodiment.
Figure 4:
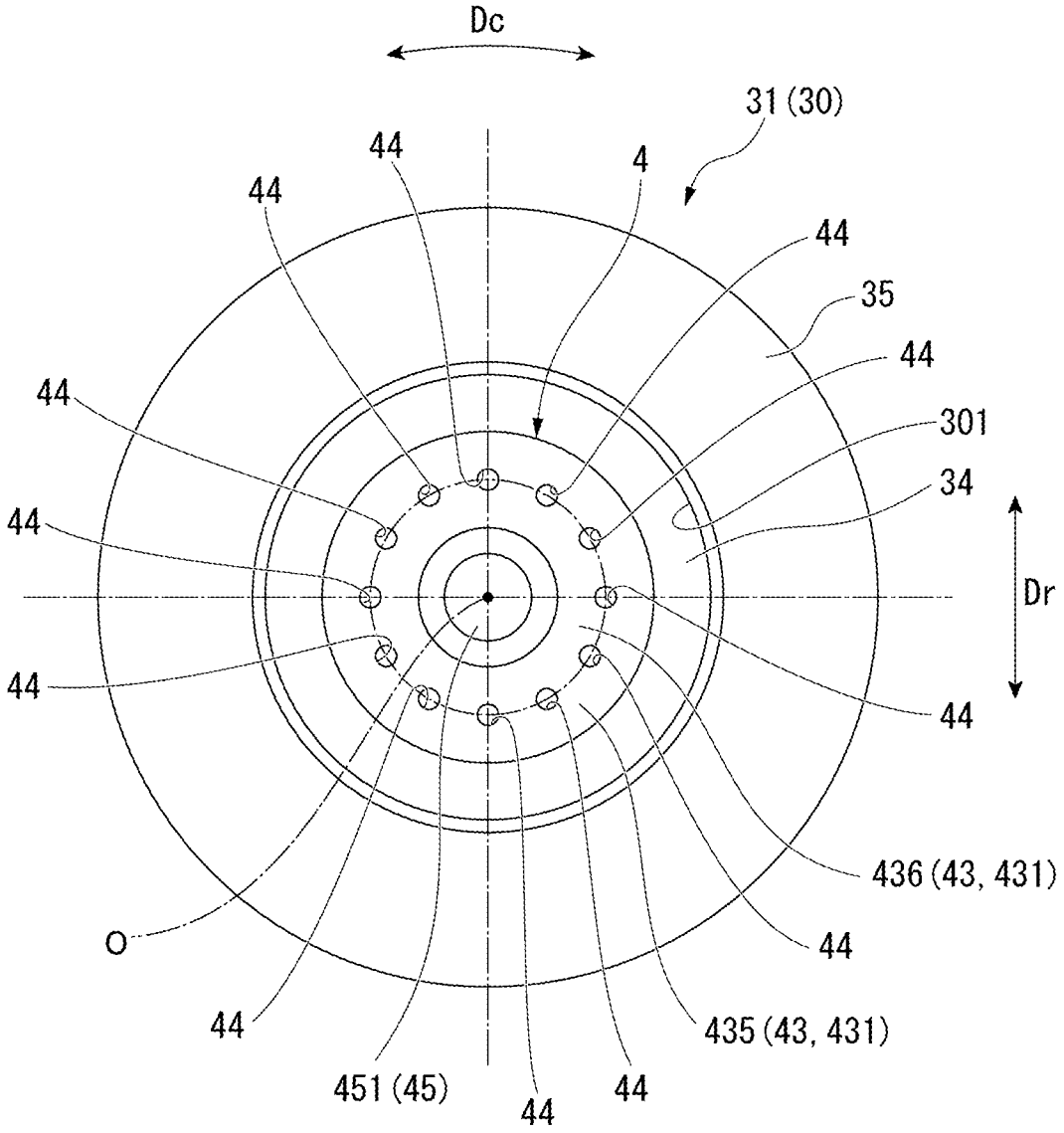
FIG. 4 is a diagram showing a state in which the first impeller of FIG. 3 is viewed from a first side in the axial direction.

The impeller 30 uses a centrifugal force to compress the gas by rotating. The plurality of impellers 30 are adjacent to each other in the axial direction Da. Each of the plurality of impellers 30 is a so-called closed impeller including a disk 4, a blade 34, and a cover 35. Hereinafter, a basic configuration of the impeller 30 will be described with reference to FIGS. 3 and 4 showing a first impeller 31 described below.

The disk 4 is formed in a disk shape centered on the axis O and has a solid structure having a buried center. The disk 4 of the present embodiment has a disk shaft portion 41 and a disk outer peripheral portion 42.

The disk shaft portion 41 is a solid portion of the disk 4 including a central portion. The disk shaft portion 41 is formed in a circular cross section centered on the axis O. The disk shaft portion 41 of the present embodiment has a disk surface 43, a bolt hole 44, and a disk fitting portion 45.

At least one disk surface 43 is formed on the disk shaft portion 41. The disk surface 43 is a flat surface centered on the axis O when viewed from the axial direction Da. The disk surface 43 faces the axial direction Da. The disk surfaces 43 face each other in the axial direction Da between the adjacent impellers 30. That is, when the plurality of impellers 30 are adjacent to each other in the axial direction Da, the disk surface 43 of one impeller 30 and the disk surface 43 of another impeller 30 adjacent to the one impeller 30 face each other in the axial direction Da. The disk surface 43 has a contact surface 435 and a non-contact surface 436.

The contact surface 435 is a portion of the disk surface 43 and is a surface that comes into contact with the disk surface 43 of another adjacent impeller 30. That is, in the adjacent impellers 30, the contact surface 435 of one impeller 30 and the contact surface 435 of another impeller 30 adjacent to the one impeller 30 are in contact with each other. At least a portion of the contact surface 435 is located outside the bolt hole 44 in the radial direction Dr. The contact surface 435 of the present embodiment is a surface having an annular shape located on the outside in the radial direction Dr so as not to overlap the bolt hole 44.

The non-contact surface 436 is a portion of the disk surface 43, and is a region inside the contact surface 435 in the radial direction Dr. The non-contact surface 436 is a surface separated from the disk surface 43 of another adjacent impeller 30 in the axial direction Da. That is, in the adjacent impellers 30, the non-contact surface 436 of one impeller 30 and the non-contact surface 436 of another impeller 30 adjacent to the one impeller 30 face each other without being in contact with each other in a state of forming a minute gap. At least a portion of the non-contact surface 436 is located inside the bolt hole 44 in the radial direction Dr. The non-contact surface 436 of the present embodiment is a surface having an annular shape located inside the bolt hole 44 in the radial direction Dr and outside the disk fitting portion 45 described below in the radial direction Dr.

Further, the disk shaft portion 41 is formed with a plurality of bolt holes 44 into which bolts 71, which will be described below, are inserted. The bolt hole 44 is formed so as to penetrate the disk shaft portion 41 in the axial direction Da at a position deviated outward from the axis O in the radial direction Dr. The plurality of bolt holes 44 (twelve in the present embodiment) are formed on the disk surface 43 in the circumferential direction Dc centered on the axis O. The plurality of bolt holes 44 are evenly spaced apart. The bolt hole 44 is a hole formed in a circular shape slightly larger than the outer shape of the bolt 71 when viewed from the axial direction Da. A portion of the region of the disk surface 43 in which the bolt holes 44 are formed may be the contact surface 435 or the non-contact surface 436.

The disk fitting portion 45 protrudes or is recessed in the axial direction Da inside the bolt hole 44 in the radial direction Dr, and thus, the adjacent impellers 30 fit each other and movements of the impellers in the radial direction Dr are restricted from each other. The disk fitting portion 45 is formed at the center of the disk surface 43 so as to overlap the axis O when viewed from the axial direction Da. In the present embodiment, the disk fitting portion 45 includes a fitting convex portion 451 and a fitting concave portion 452.

The fitting convex portion 451 is formed on the disk surface 43 facing the first side Da1 in the axial direction Da. The fitting convex portion 451 protrudes from the disk surface 43 toward the first side Da1 in the axial direction Da so as to form a columnar shape centered on the axis O.

The fitting concave portion 452 is formed on the disk surface 43 facing the second side Da2 in the axial direction Da. The fitting concave portion 452 is formed centered on the axis O so as to overlap the fitting convex portion 451 when viewed from the axial direction Da. The fitting concave portion 452 is recessed in a circular shape when viewed from the axial direction Da. The fitting concave portion 452 is formed to be slightly smaller than the fitting convex portion 451 when viewed from the axial direction Da. Therefore, the fitting convex portion 451 of one impeller 30 is fitted into the fitting concave portion 452 of another impeller 30 by shrink fitting or the like, and thus, positions of the one impeller 30 and another impeller 30 in the radial direction Dr are restricted.

The disk outer peripheral portion 42 protrudes outward from the disk shaft portion 41 in the radial direction Dr so as to extend from an outer edge of the disk shaft portion 41. The disk outer peripheral portion 42 is integrally formed with the disk shaft portion 41 and is formed as one member.

The blade 34 extends from the disk outer peripheral portion 42 to the cover 35. The plurality of blades 34 are disposed at intervals in the circumferential direction Dc around the axis O.

The cover 35 is disposed on the first side Da1 in the axial direction Da with respect to the disk outer peripheral portion 42 and the plurality of blades 34. The cover 35 has a disk shape and is formed so as to cover the plurality of blades 34. The disk outer peripheral portion 42, the blade 34, and the cover 35 form an impeller flow path 301 for circulating gas inside the impeller 30. The blade 34 and the cover 35 are formed at positions that overlap only the disk outer peripheral portion 42 when viewed from the axial direction Da, and do not overlap the disk shaft portion 41.

As shown in FIG. 2, in the present embodiment, the impeller 30 has a plurality of first impellers 31 and a second impeller 32. The first impellers 31 are a plurality of (three in the present embodiment) impellers 30 on the upstream side including the most upstream impeller 30 among the plurality of impellers 30. The second impeller 32 is disposed to be closest to the second side Da2 in the axial direction Da among the plurality of impellers 30. Therefore, the second impeller 32 is only the most downstream impeller 30. That is, the second impeller 32 is disposed on the second sides Da2 of the plurality of first impellers 31 in the axial direction Da. The first impeller 31 and the second impeller 32 have different shapes of the disk shaft portions 41.

The disk shaft portion 41 of the first impeller 31 (hereinafter, referred to as the first disk shaft portion 41A) is formed in a columnar shape centered on the axis O. The first disk shaft portion 41A is formed so that a length in the axial direction Da is about the same as that of one diaphragm 22. That is, the first disk shaft portion 41A is formed so as to protrude from the blade 34 to the second side Da2 in the axial direction Da when viewed from the radial direction Dr. The first disk shaft portion 41A has two surfaces, a first disk surface 431 and a second disk surface 432, as the disk surface 43.

The first disk surface 431 is a flat surface facing the first side Da1 in the axial direction Da. The first disk surface 431 is formed in a circular shape centered on the axis O when viewed from the axial direction Da. The fitting convex portion 451 is formed on the first disk surface 431.

The second disk surface 432 is a flat surface facing the second side Da2 in the axial direction Da. The second disk surface 432 is formed in a circular shape centered on the axis O when viewed from the axial direction Da. The second disk surface 432 is formed to have the same size as the first disk surface 431. The fitting concave portion 452 is formed on the second disk surface 432.

The disk shaft portion 41 of the second impeller 32 (hereinafter, referred to as the second disk shaft portion 41B) is formed in a columnar shape centered on the axis O. The second disk shaft portion 41B has a second disk shaft portion main body 48 and a second disk extension portion 49.

The second disk shaft portion main body 48 is formed in a columnar shape centered on the axis O. The second disk shaft portion main body 48 is formed so that a length in the axial direction Da is about the same as that of one diaphragm 22. The second disk shaft portion main body 48 has the same shape as the first disk shaft portion 41A. The second disk shaft portion main body 48 has only one surface of the first disk surface 431 as the disk surface 43. The second disk shaft portion main body 48 is formed with a first nut accommodating concave portion 481 capable of accommodating a nut 72, which will be described below, on a surface facing the second side Da2 in the axial direction Da. The first nut accommodating concave portion 481 is recessed from the surface of the second disk shaft portion main body 48 facing the second side Da2 in the axial direction Da toward the first side Da1 in the axial direction Da. A plurality of first nut accommodating concave portions 481 are formed at positions overlapping the bolt holes 44 when viewed from the axial direction Da. The first nut accommodating concave portion 481 is formed in a circular shape larger than the bolt hole 44 centered on the bolt hole 44 when viewed from the axial direction Da.

The second disk extension portion 49 extends from the second disk shaft portion main body 48 toward the second side Da2 in the axial direction Da. The second disk extension portion 49 is formed in a columnar shape centered on the axis O and smaller than the second disk shaft portion main body 48 when viewed from the axial direction Da. That is, the second disk extension portion 49 is formed inside the first nut accommodating concave portion 481 in the radial direction Dr so as to be surrounded by the first nut accommodating concave portion 481 when viewed from the axial direction Da. The second disk extension portion 49 is integrally formed with the second disk shaft portion main body 48 and is formed as one member. The second disk extension portion 49 is formed with a screw hole 491 for fixing the coupling hub 60 on the surface facing the second side Da2 in the axial direction Da.

The balance piston 50 is disposed on the first sides Da1 in the axial direction DA with respect to the plurality of impellers 30. The balance piston 50 of the present embodiment is adjacent to the most upstream impeller 30 (the first impeller 31 disposed to be closest to the first side Da1 among the plurality of first impellers 31). As shown in FIG.

1, the balance piston 50 is disposed at a position where the position in the axial direction Da overlaps with the suction-side head 231. As shown in FIG. 2, the balance piston 50 has a piston shaft portion 51, a pressure receiving portion 52, and a piston extension portion 53.

The piston shaft portion 51 is disposed so as to be in contact with the first impeller 31 disposed to be closest to the first side Da1 in the most axial direction Da.

The piston shaft portion 51 is formed in a columnar shape centered on the axis O. The piston shaft portion 51 has a first piston surface 54, a second piston surface 55, and a piston bolt hole 56.

The first piston surface 54 is a flat surface facing the first side Da1 in the axial direction Da. The first piston surface 54 is formed in an annular shape centered on the axis O when viewed from the axial direction Da. A second nut accommodating concave portion 541 capable of accommodating the nut 72, which will be described below, is formed on the first piston surface 54. The second nut accommodating concave portion 541 is recessed from the first piston surface 54 toward the second side Da2 in the axial direction Da. A plurality of second nut accommodating concave portions 541 are formed at positions overlapping the bolt holes 44 when viewed from the axial direction Da. The second nut accommodating concave portion 541 is formed in a circular shape larger than the bolt hole 44 with the bolt hole 44 as the center when viewed from the axial direction Da. That is, the second nut accommodating concave portion 541 has the same shape as the first nut accommodating concave portion 481.

The second piston surface 55 is a flat surface facing the second side Da2 in the axial direction Da. The second piston surface 55 faces the first disk surface 431 of the most upstream first impeller 31. That is, in a state where the balance piston 50 is fixed to the impeller 30, the second piston surface 55 and the first disk surface 431 of the first impeller 31 face each other in the axial direction Da. The second piston surface 55 is formed in a circular shape centered on the axis O when viewed from the axial direction Da. The second piston surface 55 is formed with a piston-side concave portion 551 into which the fitting convex portion 451 can be inserted. The piston-side concave portion 551 is formed centered on the axis O so as to overlap the fitting convex portion 451 when viewed from the axial direction Da. The piston-side concave portion 551 is recessed to have a circular shape when viewed from the axial direction Da. The piston-side concave portion 551 is formed to be slightly smaller than the fitting convex portion 451 when viewed from the axial direction Da. That is, the piston-side concave portion 551 has the same shape as the fitting concave portion 452. Therefore, the fitting convex portion 451 of the first impeller 31 is fitted into the piston-side concave portion 551 by shrink fitting or the like, and thus, position of the most upstream first impeller 31 and the balance piston 50 in the radial direction Dr are restricted.

The piston bolt hole 56 is formed so as to penetrate the piston shaft portion 51 in the axial direction Da at a position deviated outward from the axis O in the radial direction Dr. The piston bolt hole 56 penetrates from the first piston surface 54 to the second piston surface 55. The plurality of piston bolt holes 56 (twelve in the present embodiment) are formed on the first piston surface 54 and the second piston surface 55 in the circumferential direction Dc centered on the axis O. The piston bolt hole 56 is a hole formed in a circular shape slightly larger than the outer shape of the bolt 71 when viewed from the axial direction Da. The piston bolt hole 56 of the present embodiment is formed so as to have the same position and shape as the bolt hole 44 when viewed from the axial direction Da.

The pressure receiving portion 52 protrudes in an annular shape outward from the piston shaft portion 51 in the radial direction Dr. The pressure receiving portion 52 protrudes outward in the radial direction Dr from a portion of the outer edge of the piston shaft portion 51. A length of the pressure receiving portion 52 in the axial direction Da is shorter than a length of the piston shaft portion 51 in the axial direction Da. The pressure receiving portion 52 is integrally formed with the piston shaft portion 51 and is formed as one member. The pressure receiving portion 52 has a first pressure receiving surface 521 and a second pressure receiving surface 522.

The first pressure receiving surface 521 is a flat surface facing the first side Da1 in the axial direction Da. The first pressure receiving surface 521 is formed in an annular shape centered on the axis O when viewed from the axial direction Da. As shown in FIG. 1, the first pressure receiving surface 521 is disposed in a first space S1 formed in the suction-side head 231. The first space S1 is a space communicating with the discharge port 223. The first space S1 and the discharge port 223 are connected by a connection pipe 59.

The second pressure receiving surface 522 is a flat surface facing the second side Da2 in the axial direction Da. The second pressure receiving surface 522 is formed in an annular shape centered on the axis O when viewed from the axial direction Da. The second pressure receiving surface 522 is formed so that the position of the radial direction Dr overlaps that of the first pressure receiving surface 521. The second pressure receiving surface 522 is disposed in a second space S2 formed in the suction-side head 231. The second space S2 is a space that communicates with the suction port 221. The second space S2 is located on the second side Da2 of the first space S1 in the axial direction Da. A space between the second space S2 and the first space S1 is sealed by a third seal portion 83, which will be described below.

As shown in FIG. 2, the piston extension portion 53 extends from the piston shaft portion 51 toward the first side Da1 in the axial direction Da. When viewed from the axial direction Da, the piston extension portion 53 is formed in a columnar shape centered on the axis O and smaller than the piston shaft portion 51. That is, the piston extension portion 53 is formed inside the second nut accommodating concave portion 541 in the radial direction Dr so as to be surrounded by the second nut accommodating concave portion 541 when viewed from the axial direction Da. The piston extension portion 53 is integrally formed with the piston shaft portion 51 and is formed as one member. A thrust collar 531 protruding to the outside in the radial direction Dr is formed at a tip on the first side Da1 of the piston extension portion 53 in the axial direction Da.

Figure 5:
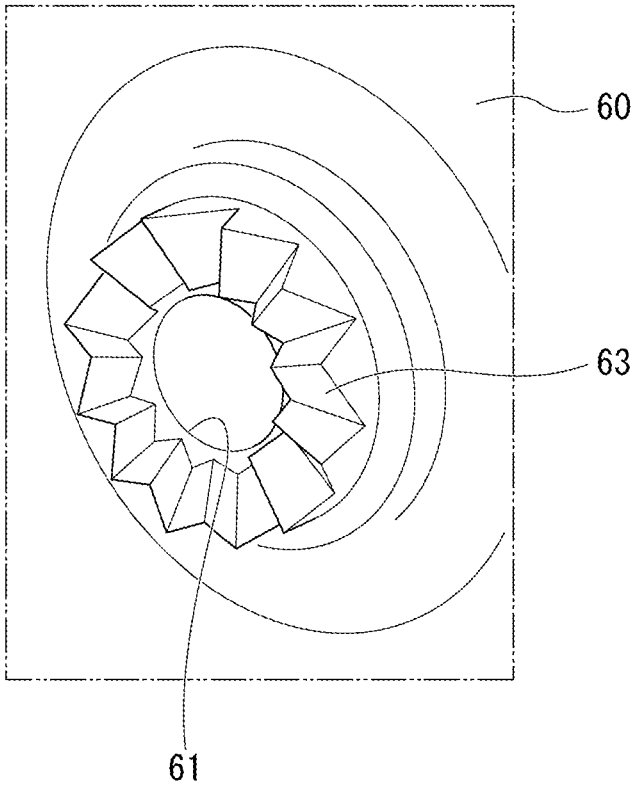
FIG. 5 is an enlarged view of a main part showing a curvic coupling formed on a coupling hub.

The coupling hub 60 can be connected to a rotor of another rotating machine such as a steam turbine or a motor. The coupling hub 60 is formed in a columnar shape centered on the axis O. A flange is formed at an end portion on the second side Da2 of the coupling hub 60 in the axial direction Da so as to protrude outward in the radial direction Dr. The coupling hub 60 is detachably fixed to the second impeller 32. Specifically, the coupling hub 60 is formed with a bolt insertion hole 61 that penetrates the coupling hub 60 centered on the axis O. The coupling hub 60 is fixed to the second disk extension portion 49 by fixing a fixing bolt 62 inserted through the bolt insertion hole 61 to the screw hole 491 of the second disk extension portion 49. Further, as shown in FIG. 5, a curvic coupling 63 which has a plurality of convex portions or concave portions arranged in the circumferential direction Dc and is formed in a tooth shape is formed on an end surface of the coupling hub 60 facing the first side Da1 in the axial direction Da. The curvic coupling 63 is formed at a position deviated outward from the axis O in the radial direction Dr. A concave portion corresponding to the shape of the curvic coupling 63 is formed around the screw hole 491 on the surface of the second disk extension portion 49 facing the second side Da2 in the axial direction Da. By fitting the curvic coupling 63 into the concave portion of the second disk extension portion 49, the position of the coupling hub 60 in the radial direction Dr with respect to the second disk extension portion 49 is restricted.

The bolt fixing portion 70 fixes the plurality of impellers 30 arranged in the axial direction Da and the balance piston 50 together. The bolt fixing portion 70 has a bolt 71 and a pair of nuts 72. Like a stud bolt, the bolt 71 has no head and includes only a screw portion. The bolt 71 has a length in the axial direction Da such that an end portion reaches the first nut accommodating concave portion 481 and the second nut accommodating concave portion 541 in a state of being inserted into the bolt hole 44 and the piston bolt hole 56. The nut 72 is formed in a size that can be accommodated in the first nut accommodating concave portion 481 and the second nut accommodating concave portion 541. The pair of nuts 72 are removable from each other at both ends of the bolt 71.

As shown in FIG. 1, the seal portion 8 seals between the rotor 3 and the casing 2. The seal portion 8 of the present embodiment includes a first seal portion 81, a second seal portion 82, and a third seal portion 83.

The first seal portion 81 seals between an inner peripheral surface of the suction-side head 231 and an outer peripheral surface of the piston extension portion 53. The first seal portion 81 is a dry gas seal. The first seal portion 81 can be attached to or detached from the suction-side head 231 and the piston extension portion 53.

The second seal portion 82 seals between an inner peripheral surface of the discharge-side head 232 and an outer peripheral surface of the second disk extension portion 49. The second seal portion 82 is a dry gas seal. The second seal portion 82 can be attached to or detached from the discharge-side head 232 and the piston extension portion 53.

The third seal portion 83 seals between the inner peripheral surface of the suction-side head 231 and an outer peripheral surface of the pressure receiving portion 52. The third seal portion 83 is a labyrinth seal. The third seal portion 83 is disposed at a position separated from the first seal portion 81 to the second side Da2 in the axial direction Da. The third seal portion 83 seals between the first space S1 and the second space S2. The third seal portion 83 is fixed to the suction-side head 231.

The bearing portion 9 rotatably supports the rotor 3 with respect to the casing 2 centered on the axis O. The bearing portion 9 of the present embodiment includes a first bearing portion 91, a second bearing portion 92, and a third bearing portion 93.

The first bearing portion 91 is a journal bearing that rotatably supports the piston extension portion 53. The first bearing portion 91 receives a load in the radial direction Dr acting on the end portion of the rotor 3 on the first side Da1 in the axial direction Da.

The second bearing portion 92 is a journal bearing that rotatably supports the second disk extension portion 49. The second bearing portion 92 receives a load in the radial direction Dr acting on the end portion of the rotor 3 on the second side Da2 in the axial direction Da. The second bearing portion 92 is attached to the inside of the bearing holder 95 having a cylindrical shape. The bearing holder 95 is fixed to the discharge-side head 232 by using a detachable fixing means such as a bolt 71. Further, by removing the bearing holder 95 from the discharge-side head 232, the second seal portion 82 can be moved to the outside with respect to the discharge-side head 232.

The third bearing portion 93 is a thrust bearing that rotatably supports the thrust collar 531 of the piston extension portion 53. The third bearing portion 93 receives a load acting on the rotor 3 in the axial direction Da. The third bearing portion 93 is attached to the inside of the bearing cover 96 having a box shape together with the first bearing portion 91. The bearing cover 96 is fixed to the suction-side head 231 by using a removable fixing means such as a bolt 71.

(Action effect)

In the compressor 1 having the above configuration, the impeller 30 has a solid structure having the disk shaft portion 41. That is, the impeller 30 is not a structure that is fixed to the outer peripheral surface of the shaft by shrink fitting or the like. Therefore, a large hole for inserting the shaft is not formed in the center of the impeller 30. Then, in a state where the plurality of first impellers 31 and second impellers 32, which are solid impellers 30, are stacked in the axial direction Da, the balance piston 50 is further stacked in the axial direction Da. Both ends of the bolt 71 inserted into the bolt hole 44 and the piston bolt hole 56 are tightened and fixed to the plurality of stacked first impeller 31, the second impeller 32, and the balance piston 50 with nuts 72, and thus, the rotor 3 is formed. When such a rotor 3 is rotated, the impeller 30 does not have a large hole, and thus, strength of the impeller 30 against a load generated by centrifugal force can be greatly improved. Further, the load due to the centrifugal force increases toward the inside of the radial direction Dr, and the impeller 30 also generates a thrust force in the axial direction Da due to the compressed gas. As a result, the load acts on the impeller 30 toward the outside in the radial direction Dr and the axial direction Da so as to be deformed diagonally. However, the impellers 30 are in contact with each other on the contact surface 435 located outside the bolt hole 44 in the radial direction Dr, and the impellers 30 are not in contact with each other on the non-contact surface 436 located inside the contact surface 435. Therefore, the contact surface 435 can stably receive the load toward the outside in the radial direction Dr and the axial direction Da. Accordingly, torque is stably transmitted between the impellers 30, and even when the rotor 3 is rotated at high speed without a shaft, it is possible to prevent the impellers 30 from shifting from each other. As a result, the strength of the impeller 30 against the load due to centrifugal force can be improved while the rotor 3 is stably rotated at high speed.

Further, the positions of the radial direction Dr of the first impellers 31 arranged in the axial direction Da and the first impeller 31 and the second impeller 32 are restricted by fitting the fitting convex portions 451 and the fitting concave portions 452 into each other. Before the position is completely fixed by the bolt 71, the positions of the first impellers 31 in the radial direction Dr and the positions of the second impeller 32 and the first impeller 31 in the radial direction Dr can be aligned. As a result, centering can be performed when the plurality of impellers 30 are stacked in the axial direction Da. As a result, workability when assembling the rotor 3 can be improved.

Further, the position of the radial direction Dr is restricted by fitting the fitting convex portion 451 of the most upstream first impeller 31 into the piston-side concave portion 551 of the balance piston 50. Therefore, the positions of the balance piston 50 and the most upstream first impeller 31 in the radial direction Dr can be aligned before being completely fixed by the bolt 71. As a result, centering can be performed when the balance piston 50 and the impeller 30 are stacked in the axial direction Da. Therefore, the workability at the time of assembling the main component constituting the central region of the radial direction Dr including the axis O in the rotor 3 can be greatly improved.

Further, the coupling hub 60 connected to another rotating machine can be attached to and detached from the second disk extension portion 49 with the fixing bolt 62. By removing the coupling hub 60 from the second impeller 32, components disposed at positions closer to the second impeller 32 on the first side Da1 of the coupling hub 60 such as the second bearing portion 92 and the second seal portion 82 in the axial direction Da can be easily attached to and detached from the second impeller 32. Therefore, it possible to improve workability when performing repairs and the like.

Further, the second bearing portion 92 is disposed at the position overlapping the coupling hub 60 connected to another rotating machine in the axial direction Da. The second bearing portion 92 rotatably supports the coupling hub 60 to support the end portion of the rotor 3. Therefore, the rotor 3 and another rotating machine are connected at a position closer to the second bearing portion 92 that supports the rotor 3. Therefore, an amount of protrusion of the rotor 3 outward in the axial direction Da from the second bearing portion 92 can be suppressed. As a result, it is possible to suppress occurrence of problems in rotor dynamics caused by a large weight of a region protruding from the bearing when the rotor 3 is rotated at high speed such as vibration. Therefore, it is possible to rotate the rotor 3 at high speed in a more stable state.

Further, the balance piston 50 is fixed to the first side Da1 of the most upstream first impeller 31 in the axial direction Da. That is, the balance piston 50 is disposed on the first sides Da1 in the axial direction Da with respect to the plurality of impellers 30. The first pressure receiving surface 521 of the pressure receiving portion 52 is disposed in the first space S1 communicating with the discharge port 223, and the second pressure receiving surface 522 is disposed in the second space S2 communicating with the suction port 221. Since a pressure of the discharge port 223 is much higher than that of the suction port 221, in the pressure receiving portion 52, a force is generated from the first side Da1 to the second side Da2 in the axial direction Da so as to go from the first pressure receiving surface 521 to the second pressure receiving surface 522. Meanwhile, the gas flowing through the impeller 30 is compressed in the downstream where the discharge port 223 is disposed compared in the upstream where the suction port 221 is disposed, and thus, the pressure of the gas increases. Therefore, in the plurality of impellers 30, a force from the second side Da2 in the axial direction Da to the first side Da1 is generated by the gas. As a result, a portion of the force acting on the plurality of impellers 30 by the gas is canceled by the force acting on the balance piston 50 via the pressure receiving portion 52. As a result, the thrust force (force in the axial direction Da) acting on the rotor 3 can be reduced, and the thrust bearing can be made smaller. In addition, it is possible to prevent a force that spreads outward in the axial direction Da from acting on the bolts 71 that fix the plurality of impellers 30 and the balance piston 50. As a result, even when a tightening force of the bolt 71 is suppressed, a surface pressure between the contact surfaces of the adjacent disks 4 can be secured, and thus, the diameter of the bolt hole 44 can be reduced. By reducing the sizes of the bolt holes 44 formed in the disk shaft portion 41, the strength of the disk shaft portion 41 can be improved. Therefore, the strength of the rotor 3 against the centrifugal force when rotated at high speed can be improved.

Other Embodiments

As described above, the embodiment of the present disclosure is described in detail with reference to the drawings. However, the specific configurations are not limited to the embodiment, and include a design modification or the like within a scope which does not depart from the gist of the present disclosure.

For example, the disk fitting portion 45 may have any shape as long as the adjacent impellers 30 can be fitted to each other and the movements of the impellers in the radial direction Dr can be restricted from each other. Therefore, the disk fitting portion 45 is not limited to the structure formed centered on the axis O like the fitting convex portion 451 and the fitting concave portion 452, but may have a structure formed at a position deviated from the axis O. Further, the disk fitting portion 45 is not limited to the structure formed by only one convex portion or one concave portion, such as the fitting convex portion 451 and the fitting concave portion 452. For example, the disk fitting portion 45 may have a structure such as the curvic coupling 63 formed on the coupling hub 60 as shown in FIG. 5. Therefore, the disk fitting portion 45 may have a structure having a plurality of convex portions or concave portions arranged in the circumferential direction Dc at positions deviated outward from the axis O in the radial direction Dr.

According to the disk fitting portion 45 having such a structure, since the disk fitting portion 45 is fitted by the plurality of convex portions and concave portions, the adjacent impellers 30 are firmly supported by each other. As a result, the force when fixing the plurality of impellers 30 by the bolts 71 can be reduced as compared with a case where the torque is transmitted by the friction between the contact surfaces of the disks 4. As a result, the strength of the bolt 71 can be suppressed. Therefore, the diameter of the bolt hole 44 can be reduced. By reducing the sizes of the bolt holes 44, the strength of the disk shaft portion 41 can be improved. Therefore, it is possible to improve the strength of the rotor 3 against the load due to the centrifugal force when the rotor 3 is rotated at high speed.

<Additional Notes>

The compressor 1 described in the embodiment is grasped as follows, for example.

(1) According to a first aspect, there is provided a compressor 1 including: a rotor 3 that is rotatable centered on an axis O; and a casing 2 that covers the rotor 3 from an outside in a radial direction Dr around the axis O, in which the rotor 3 includes a plurality of impellers 30 that are adjacent to each other in an axial direction Da in which the axis O extends wherein each of the a plurality of impellers 30 includes a disk 4 having a solid structure having a buried center and formed in a disk shape centered on the axis O, and a plurality of bolts 71 that is configured to fix the plurality of impellers 30 arranged in the axial direction Da together, the disk 4 includes a disk surface 43 that is centered on the axis O when viewed from the axial direction Da and faces the axial direction Da, and a plurality of bolt holes 44 which are formed on the disk surface 43 in a circumferential direction Dc centered on the axis O so as to penetrate the disk 4 in the axial direction Da at a position deviated outward from the axis O in the radial direction Dr and through which the bolts 71 are inserted, and the disk surface 43 includes a contact surface 435 which is at least partly located outside the bolt hole 44 in the radial direction Dr and is in contact with the disk surface 43 of another adjacent impeller 30, and a non-contact surface 436 that is a region of the disk surface 43 inside the contact surface 435 in the radial direction Dr and is separated from the disk surface 43 of another adjacent impeller 30 in the axial direction Da.

In the compressor 1, the impeller 30 has a solid structure. That is, the impeller 30 is not a structure that is fixed to an outer peripheral surface of a shaft by shrink fitting or the like. Therefore, a large hole for inserting the shaft is not formed in a center of the impeller 30. When the rotor 3 is rotated, the impeller 30 does not have a large hole, and thus, strength of the impeller 30 against a load generated by centrifugal force can be greatly improved. Further, the load due to the centrifugal force increases toward the inside of the radial direction Dr, and the impeller 30 also has a thrust force in the axial direction Da due to the compressed gas. As a result, a load acts on the impeller 30 toward the outside in the radial direction Dr and the axial direction Da so as to be deformed diagonally. However, the impellers 30 are in contact with each other on the contact surface 435 located outside the bolt hole 44 in the radial direction Dr, and the impellers 30 are not in contact with each other on the non-contact surface 436 located inside the contact surface 435. Therefore, the contact surface 435 can stably receive the load toward the outside in the radial direction Dr and the axial direction Da generated by the rotor 3 rotating at high speed. As a result, a stable frictional force is generated on the contact surface 435, and the adjacent impellers 30 can be firmly fixed to each other. Therefore, torque is stably transmitted between the impellers 30, and even when the rotor 3 is rotated at high speed without a shaft, it is possible to prevent the impellers 30 from shifting from each other. As a result, the strength of the impeller 30 against the load due to centrifugal force can be improved while the rotor 3 is stably rotated at high speed.

(2) In the compressor 1 according to a second aspect, in the compressor 1 according to (1), the disk 4 may include a disk fitting portion 45 which protrudes or is recessed in the axial direction Da inside the bolt hole 44 in the radial direction Dr so that adjacent impellers 30 fit to each other and movements of the plurality of impellers 30 in the radial direction Dr are restricted from each other.

Accordingly, the positions of the impellers 30 in the radial direction Dr can be aligned with each other before the positions of the impellers 30 are completely fixed by the bolts 71. As a result, centering can be performed when the plurality of impellers 30 are stacked in the axial direction Da. Accordingly, workability when assembling the rotor 3 can be improved.

(3) In the compressor 1 according to a third aspect, in the compressor 1 according to (2), the disk fitting portion 45 may include a plurality of convex portions or concave portions arranged in the circumferential direction Dc at positions deviated outward from the axis O in the radial direction Dr.

Therefore, since the fitting is performed by the plurality of convex portions and concave portions, a frictional force between the adjacent impellers 30 at the time of fitting is improved. Therefore, the adjacent impellers 30 are firmly supported by each other. As a result, a force when fixing the plurality of impellers 30 with the bolts 71 can be reduced. Accordingly, strength of the bolt 71 can be suppressed. Therefore, a diameter of the bolt hole 44 can be reduced. By reducing a size of the bolt hole 44, strength of the disk 4 can be improved.

(4) In the compressor 1 according to a fourth aspect, in the compressor 1 according to any one of (1) to (3), the rotor 3 may further include a coupling hub 60 which is connectable to a rotor of another rotating machine 3 and fixed to an impeller 30, which is one of the plurality of impellers 30, and the coupling hub 60 may be attachable to or detachable from the impeller 30.

As a result, by removing the coupling hub 60 from the impeller 30, a component disposed at positions close to the impeller 30 can be easily attached to or detached from the coupling hub 60. Accordingly, workability when assembling the rotor 3 can be improved.

(5) In the compressor 1 according to a fifth aspect, the compressor 1 according to (4) may further include a bearing portion 9 that rotatably supports the rotor 3 with respect to the casing 2, in which the bearing portion 9 may be disposed at a position overlapping the coupling hub 60 in the axial direction Da and may rotatably support the coupling hub 60.

Accordingly, the rotor 3 and another rotating machine are connected at a position close to the bearing portion 9 that supports the rotor 3. Therefore, an amount of protrusion of the rotor 3 outward in the axial direction Da from the bearing portion 9 can be suppressed. As a result, it is possible to suppress occurrence of problems in the rotor 3 dynamics caused by the large weight of the region protruding from the bearing when the rotor 3 is rotated at high speed such as vibration. Accordingly, it is possible to rotate the rotor 3 at high speed in a more stable state.

(6) In the compressor 1 according to a sixth aspect, in the compressor 1 according to any one of (1) to (5), wherein the casing 2 may include a casing flow path 222 through which a working fluid flows from an impeller 30 disposed on a first side Da1 in the axial direction Da of the plurality of impellers 30 toward another impeller 30 adjacent to a second side Da2 in the axial direction Da with respect to the impeller 30, a suction port 221 through which the working fluid flows into the casing flow path 222 from an outside of the casing 2, and a discharge port 223 through which the working fluid flows to the outside from the casing flow path 222, the rotor may have a balance piston 50 disposed on the first side Da1 in the axial direction Da with respect to the plurality of impellers 30, the balance piston 50 may include a piston shaft portion 51 that is in contact with an impeller 30 disposed closest to the first side Da1 in the axial direction Da of the plurality of impellers 30, and a pressure receiving portion 52 that protrudes outward from the piston shaft portion 51 in the radial direction Dr, the pressure receiving portion 52 may have a first pressure receiving surface 521 facing the first side Da1 in the axial direction Da and a second pressure receiving surface 522 facing the second side Da2 in the axial direction Da, and the casing 2 may include a first space S1 in which the first pressure receiving surface 521 is disposed and which communicates with the discharge port 223, and a second space S2 in which the second pressure receiving surface 522 is disposed and which communicates with the suction port 221.

Accordingly, since a pressure of the discharge port 223 is much higher than that of the suction port 221, in the pressure receiving portion 52, a force is generated from the first side Da1 to the second side Da2 in the axial direction Da so as to go from the first pressure receiving surface 521 to the second pressure receiving surface 522. Meanwhile, the gas flowing through the impeller 30 is compressed in the downstream compared in the upstream, and thus, the pressure of the gas increases. Therefore, in the plurality of impellers 30, a force from the second side Da2 in the axial direction Da to the first side Da1 is generated by the gas. As a result, a portion of the force generated by the gas acting on the plurality of impellers 30 is canceled by the opposite force acting on the balance piston 50 via the pressure receiving portion 52. Therefore, the thrust force (force in the axial direction Da) acting on the rotor 3 can be reduced, and the thrust bearing can be made smaller. Further, it is possible to prevent a force that spreads outward in the axial direction Da from acting on the bolts 71 that fix the plurality of impellers 30. As a result, even when a tightening force of the bolt 71 is suppressed, a surface pressure between the contact surfaces of the disks 4 can be maintained, torque can be stably transmitted, and the diameter of the bolt hole 44 can be reduced. By reducing sizes of the bolt holes 44, the strength of the disk 4 can be improved. Therefore, the strength of the rotor 3 against the centrifugal force when the rotor 3 is rotated at high speed can be improved.

EXPLANATION OF REFERENCES

1: compressor
2: casing
21: outer casing
211: end plate
212: insertion hole
22: diaphragm
221: suction port
222: casing flow path
223: discharge port
23: head
231: suction-side head
232: discharge-side head
3: rotor
30: impeller
31: first impeller
32: second impeller
4: disk
41 disk shaft portion
43: disk surface
435: contact surface
436: non-contact surface
44: bolt hole
45: disk fitting portion
451: fitting convex portion
452: fitting concave portion
42: disk outer peripheral portion
34: blade
35: cover
301: impeller flow path
41A: first disk shaft portion
41B: second disk shaft portion
431: first disk surface
432: second disk surface
48: second disk shaft portion main body
481: first nut accommodating concave portion
49: second disk extension portion
491: screw hole
50: balance piston
51: piston shaft portion
54: first piston surface
541: second nut accommodating concave portion
55: second piston surface
551: piston-side concave portion
56: piston bolt hole
52: pressure receiving portion
521: first pressure receiving surface
S1: first space
522: second pressure receiving surface
S2: second space
59: connection pipe
53: piston extension portion
531: thrust collar
60: coupling hub
61: bolt insertion hole
62: fixing bolt
63: curvic coupling
70: bolt fixing portion
71: bolt
72: nut
8: seal portion
81: first seal portion
82: second seal portion
83: third seal portion
9: bearing portion
91: first bearing portion
92: second bearing portion
95: bearing holder
93 third bearing portion
96: bearing cover
100: bundle
O: axis
Da: axial direction
Da1: first side
Da2: second side
Dr: radial direction
Dc: circumferential direction

What is claimed is:

1. A compressor comprising:

a rotor that is rotatable about an axis; and a casing that covers the rotor from an outside in a radial direction around the axis, wherein the rotor includes a plurality of impellers that are adjacent to each other in an axial direction in which the axis extends, wherein each of the a plurality of impellers includes a disk having a solid structure having a buried center and formed in a disk shape centered on the axis, and a bolt fixing portion having a plurality of bolts that is configured to fix the plurality of impellers arranged in the axial direction together, the disk includes a disk surface that is centered on the axis when viewed from the axial direction and faces the axial direction, and a plurality of bolt holes which are formed on the disk surface in a circumferential direction centered on the axis so as to penetrate the disk in the axial direction at a position deviated outward from the axis in the radial direction and through which the bolts are inserted, and the disk surface includes a contact surface which is at least partly located outside the bolt hole in the radial direction and is in contact with the disk surface of another adjacent impeller, and a non-contact surface that is a region of the disk surface inside the contact surface in the radial direction and is separated from the disk surface of another adjacent impeller in the axial direction.

2. The compressor according to claim 1, wherein the disk includes a disk fitting portion which protrudes or is recessed in the axial direction inside the bolt hole in the radial direction so that adjacent impellers fit to each other and movements of the plurality of impellers in the radial direction are restricted from each other.

3. The compressor according to claim 2, wherein the disk fitting portion includes a plurality of convex portions or concave portions arranged in the circumferential direction at positions deviated outward from the axis in the radial direction.

4. The compressor according to claim 1, wherein the rotor further includes a coupling hub which is connectable to a rotor of another rotating machine and fixed to an impeller, which is one of the plurality of impellers, and the coupling hub is attachable to or detachable from the impeller.

5. The compressor according to claim 4, further comprising a bearing portion that rotatably supports the rotor with respect to the casing, wherein the bearing portion is disposed at a position overlapping the coupling hub in the axial direction and rotatably supports the coupling hub.

6. The compressor according to claim 1, wherein the casing includes a casing flow path through which a working fluid flows from an impeller disposed on a first side in the axial direction of the plurality of impellers toward another impeller adjacent to a second side in the axial direction with respect to the impeller, a suction port through which the working fluid flows into the casing flow path from an outside of the casing, and a discharge port through which the working fluid flows to the outside from the casing flow path, the rotor has a balance piston disposed on the first side in the axial direction with respect to the plurality of impellers, the balance piston includes a piston shaft portion that is in contact with an impeller disposed closest to the first side in the axial direction of the plurality of impellers, and a pressure receiving portion that protrudes outward from the piston shaft portion in the radial direction, the pressure receiving portion has a first pressure receiving surface facing the first side in the axial direction and a second pressure receiving surface facing the second side in the axial direction, and the casing includes a first space in which the first pressure receiving surface is disposed and which communicates with the discharge port, and a second space in which the second pressure receiving surface is disposed and which communicates with the suction port.

* * * * *